US007066670B2

(12) United States Patent
Bakken et al.

(10) Patent No.: US 7,066,670 B2
(45) Date of Patent: Jun. 27, 2006

(54) PRINTING METHOD AND APPARATUS

(75) Inventors: Christopher J. Bakken, Auburn, WA (US); Craig J. Cornelius, Woodinville, WA (US); Gary A. Gesellchen, Seattle, WA (US); Kenneth R. Hallock, Buckley, WA (US); Michael B. O'Leary, Seattle, WA (US); Scott D. Phillips, Kent, WA (US)

(73) Assignee: Tallygenicom LP, Kent, WA (US)

( * ) Notice: Subject to any disclaimer, the term of this patent is extended or adjusted under 35 U.S.C. 154(b) by 38 days.

(21) Appl. No.: 10/775,389

(22) Filed: Feb. 10, 2004

(65) Prior Publication Data

US 2005/0175387 A1 Aug. 11, 2005

(51) Int. Cl.

| | |
|---|---|
| ***B41J 29/38*** | (2006.01) |
| ***B41J 15/04*** | (2006.01) |
| ***B65H 23/32*** | (2006.01) |
| ***B65H 20/36*** | (2006.01) |

(52) U.S. Cl. ..... 400/616; 400/76; 400/611; 400/645; 400/645.4; 400/613

(58) Field of Classification Search ..... 400/605, 400/607.1, 578, 595, 596; 271/225, 266, 271/267

See application file for complete search history.

(56) References Cited

U.S. PATENT DOCUMENTS

| | | | | |
|---|---|---|---|---|
| 3,941,051 | A | | 3/1976 | Barrus et al. |
| 4,019,619 | A | | 4/1977 | Emenaker |
| 4,234,261 | A | | 11/1980 | Hendrischk et al. |
| 4,452,543 | A | | 6/1984 | Adkisson et al. |
| 4,606,663 | A | * | 8/1986 | Christoph et al. ..... 400/605 |
| 4,687,359 | A | | 8/1987 | Barrus et al. |
| 4,761,087 | A | | 8/1988 | Ward et al. |
| 4,806,036 | A | | 2/1989 | Ward et al. |
| 4,834,277 | A | * | 5/1989 | Gomoll et al. ..... 226/101 |
| 4,896,979 | A | * | 1/1990 | Nolte et al. ..... 400/605 |
| 4,932,797 | A | | 6/1990 | Emenaker et al. |
| 5,071,274 | A | | 12/1991 | Niikawa |
| 5,135,321 | A | | 8/1992 | Olsen et al. |
| 5,199,806 | A | | 4/1993 | Fujioka et al. |
| 5,221,150 | A | | 6/1993 | Fujioka et al. |
| 5,308,175 | A | * | 5/1994 | Ito ..... 400/605 |
| 5,595,446 | A | | 1/1997 | Barrus et al. |
| 5,899,613 | A | * | 5/1999 | Koike et al. ..... 399/384 |
| 5,967,677 | A | * | 10/1999 | McCue et al. ..... 400/582 |
| 5,988,903 | A | * | 11/1999 | Baitz et al. ..... 400/605 |
| 6,082,914 | A | | 7/2000 | Barrus et al. |

(Continued)

*Primary Examiner*—Daniel J. Colilla
(74) *Attorney, Agent, or Firm*—Christensen O'Connor Johnson Kindness PLLC

(57) ABSTRACT

A printer (24) for printing upon a continuous web of print receivable media (18) is provided. The printer includes a print head (28) having a media drive assembly side and a media drive assembly for moving the media across the print head. The media drive assembly is disposed only on the media drive assembly side of the print head. The printer further includes a platen (30) disposed adjacent the print head and a controller (102) coupled to the print head, the media drive assembly, and the platen. The controller controls the printer during continuous printing and single sheet printing. During continuous printing, the media is moved in a downstream direction past the print head. During single sheet printing, the media is moved past the print head in an upstream direction one sheet at a time. Further, the printer may perform single sheet pull printing or single sheet push printing.

12 Claims, 11 Drawing Sheets

U.S. PATENT DOCUMENTS 6,089,768 A 7/2000 Barrus et al.
6,155,728 A * 12/2000 Sakaino et al. ..... 400/26
6,244,768 B1 6/2001 Chang et al.
6,280,106 B1 * 8/2001 Juan et al. ..... 400/605
6,361,228 B1 3/2002 Barrus et al.
6,535,299 B1 3/2003 Scherz

* cited by examiner

PRINTING METHOD AND APPARATUS

FIELD OF THE INVENTION

The present invention relates generally to methods and apparatus for printing, and more specifically, to methods and apparatus for impact printing upon print receivable media.

BACKGROUND OF THE INVENTION

Dot matrix line printers are well known in the industry. Dot matrix line printers have an elongated bank of hammers forming a print head. The print head is shuttled back and forth over a small number of character positions during printing. That is, rather than shuttling a small print head back and forth over the entire width of the paper during printing, the print head of a dot matrix line printer is wide and shuttled only over a few character positions. For example, the print head may include 66 dot printing elements located along a linear axis or line. Each of the dot printing elements is shuttled over two character positions. Thus, back and forth shuttling of the print head allows a maximum of 132 characters to be printed. As the print head is shuttled, the dot printing elements are selectively impacted to create dots. A series of lines of dots creates a row of characters or, alternatively, a graphic image.

Dot matrix line printers are often used to print upon a continuous web of print receivable media, such as paper, fabric, metal, synthetic materials, organic materials, etc. The continuous web of print receivable media may be formed from a series of sheets of paper coupled to one another in a head-to-toe (i.e., top-to-bottom) relationship. The sheets may be blank or may have forms pre-printed thereon. The sheets may also include two or more layers, such that one or more carbon copies may be simultaneously created by printing upon the top sheet.

Typically, the paper includes a pair of detachable drive strips coupled to the sides of the paper. The drive strips include a series of evenly spaced perforations designed to be engaged by a series of pins of a pair of drive tractors. The drive tractors engage the perforations in the drive strips to drive (move) the paper past the print head.

Many previously developed dot matrix line printers use two pairs of drive tractors to move paper and control paper tension when printing upon the paper. More specifically, such previously developed printers include a first pair of tractors (one tractor located on each side of the paper) located downstream of the print head, and a second pair of tractors located upstream of the print head. The two pairs of tractors work in tandem to move the paper across the print head while maintaining an appropriate amount of tension in the paper. Recently, in order to reduce the manufacturing costs of line printers, printers that employ only one pair of tractors to move the paper across the print head have been developed. Due to the difficulty of pushing paper through the narrow gap between a print head and a platen, the tractors of such printers are located downstream of the print head. As a result, the tractors pull the paper past the print head.

When only a single pair of drive tractors are used, paper tension becomes an important issue. It is important for good print quality that paper be kept taut during printing. Consistent paper tension may be provided in single tractor dot matrix line printers by a paper iron. A paper iron usually includes a cantilevered strip of spring material that pinches paper against the platen upstream of the print head. The paper iron is biased by the spring towards the platen so as to apply a consistent paper pinching force. The friction applied to the paper by the paper iron and the platen provides controlled, consistent paper tension.

Typically, the sheets forming a continuous web of paper are printed in a continuous manner. As a result, after one sheet is printed, the next sheet is printed without the first sheet being detached from the web. However, on occasion, a user may wish to detach the first sheet for use or review prior to the printing of the second sheet. This type of printing is often called single sheet printing.

In the past, when a printer having a single pair of pull drive tractors performed single sheet printing, the print could be no closer to the top edge of a sheet than the distance between the closest tractor pin and the print hammers of the print head. Due to the presence of a ribbon shield above the print hammers, this distance is usually greater than one inch. If printing is required closer than one inch to the top edge of the sheet, a sacrificial sheet must precede the sheet to be printed. The sacrificial sheet is used to preserve tractor engagement with the paper while the printer prints upon the sheet to be printed. Thus, two sheets are required for every one that is printed. Such printing can be expensive, especially if the sheets are preprinted forms or carbon copies are to be produced. A 50% print yield can significantly increase costs for single sheet printing employing single tractor dot matrix line printers and other types of printers, in particular impact printers, employing a single pair of tractors.

Therefore, there exists a need for single tractor dot matrix line and other printers and methods of printing employing such printers that provide for single sheet printing near the top and/or bottom margins of single sheets without requiring a sacrificial sheet.

SUMMARY OF THE INVENTION

In accordance with the present invention, a new and improved printer for printing on a continuous web of print receivable media is provided. One exemplary embodiment of a printer formed in accordance with certain aspects of the present invention includes a print head having a media drive assembly side. The printer further includes a media drive assembly for moving the media past the print head, the media drive assembly disposed only on the media drive assembly side of the print head. The printer also includes a platen disposed adjacent the print head and a controller coupled to the print head, the media drive assembly, and the platen for controlling a mode of operation of the printer in accordance with user input. The mode of operation of the printer includes a continuous print mode of operation and a single sheet mode of operation. During the continuous print mode of operation, the print head, the media drive assembly, and the platen are controlled such that the media is moved by the media drive assembly past the print head in a downstream direction. During the single sheet mode of operation using push printing, the print head, the media drive assembly, and the platen are controlled such that the media is moved by the media drive assembly past the print head in an upstream direction one sheet at a time.

In one exemplary embodiment, the controller controls the printer to print in a continuous pull printing manner. More specifically, the controller controls the media drive assembly to alternatingly advance the media by pulling the media past the print head and pause media movement during printing by the print head. The controller also controls the printer to print in a single sheet push printing manner. More specifically, the controller directs the media drive assembly to alternatingly advance the media by pushing the media past the print head and pause media movement during printing by the print head.

In yet another exemplary embodiment, the controller controls the printer to print on the media in a continuous pull printing manner. More specifically, the controller controls the media drive assembly to alternatingly advance the media by pulling the media past the print head and pause media movement during printing by the print head. The controller also controls the printer to print in a single sheet pull printing manner. More specifically, the controller controls the media drive assembly to push a sheet of the media past the print head and then alternatingly advance the media by pulling the media back past the print head and pause media movement during printing by the print head.

In accordance with other aspects of the present invention, a method of controlling a printer to perform continuous sheet printing, single sheet push printing, and/or single sheet pull printing is provided. The printer includes a print head for printing on a web of continuous print receivable media and a paper drive assembly having at least one driver for moving the media. The driver is located on the downstream side of the print head. The method includes determining if continuous sheet printing is desired, and if continuous sheet printing is desired, directing the media drive assembly to alternatingly: (i) pause printing and advance the media past the print head by pulling the media; and (ii) pause media movement while the print head prints. The method also includes determining if single sheet push printing is desired, and if single sheet push printing is desired, directing the media drive assembly to alternatingly: (i) pause printing and advance the media by pushing the media past the print head; and (ii) pause media movement while the print head prints. The method further includes determining if single sheet pull printing is desired, and if single sheet pull printing is desired, directing the media drive assembly to push a sheet of the media past the print head, and alternatingly: (i) pause printing and advance the media back past the print head by pulling the media; and (ii) pause media movement while the print head prints.

BRIEF DESCRIPTION OF THE DRAWINGS

The foregoing aspects and many of the attendant advantages of this invention will become more readily appreciated by reference to the following detailed description, when taken in conjunction with the accompanying drawings, wherein.

DETAILED DESCRIPTION OF THE PREFERRED EMBODIMENT

Figure 1:
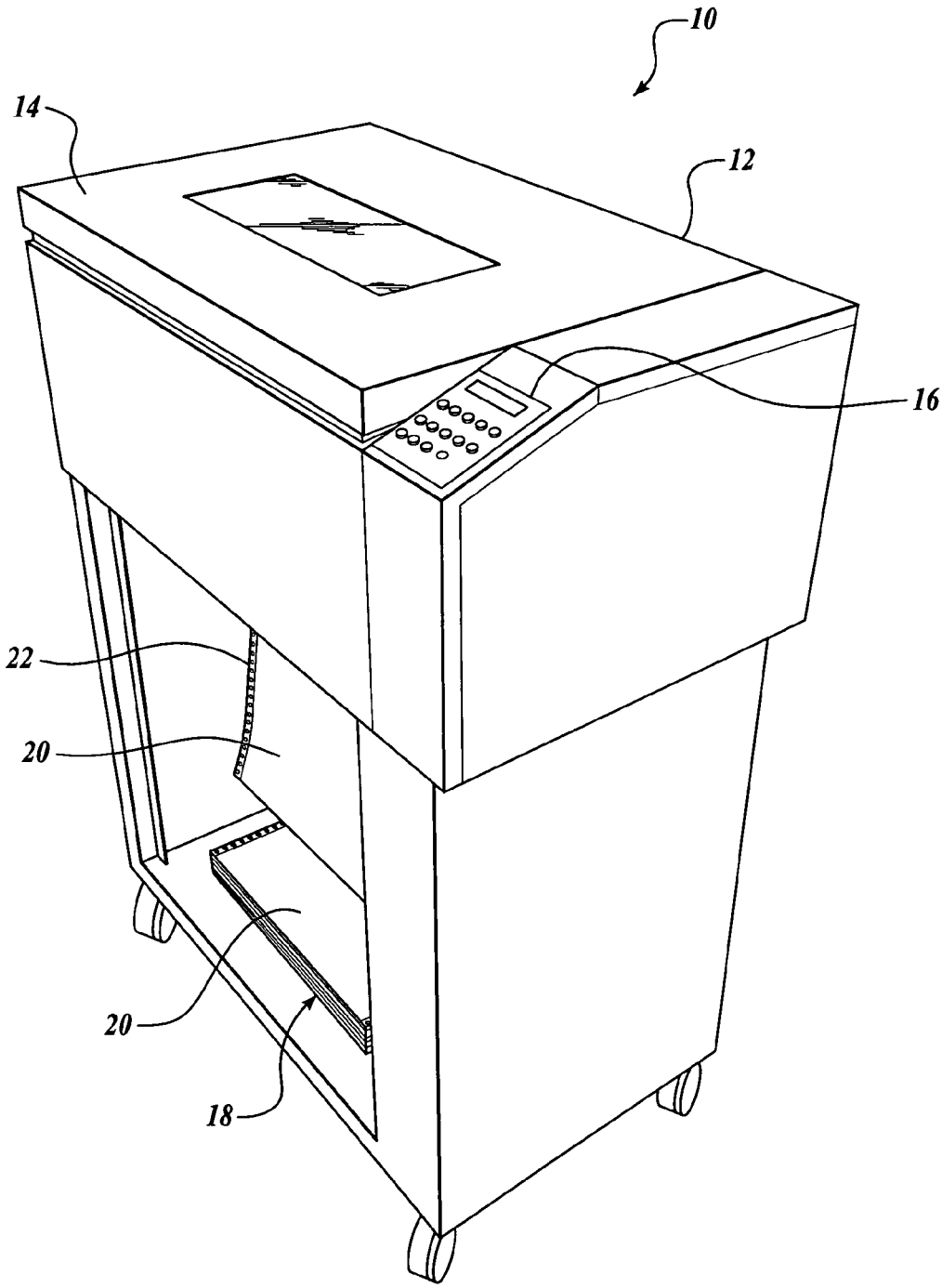
FIG. 1 is a pictorial view of a printer suitable for incorporating the present invention.

FIG. 1 illustrates a printer 10 suitable for embodying the present invention and FIGS. 2–7 illustrate one embodiment of a printer mechanism 24 suitable for implementing the present invention. Referring to FIG. 1, the printer 10 includes a cabinet 12 for enclosing the printer mechanism 24 (FIGS. 2–7). The top of the printer mechanism 24 is accessible through a top door 14 in the cabinet 12. A user interface 16 for communicating with the printer 10 is positioned on the top of the exterior of the cabinet 12, adjacent to the door 14. Although the user interface 16 is shown positioned on the exterior of the cabinet 12, it should be apparent to those skilled in the art that the user interface 16 may be disposed at other locations, such as inside the cabinet 12, or at a remote location linked to the printer assembly 10 by a communication link. Alternatively, the user interface 16 may be provided by a generic device that also performs other functions, such as a personal computer, linked to the printer via a communication link.

A quantity of print receivable media, such as continuous printer paper 18, may be stored in a lower paper bin 52 (FIG. 2) disposed on a bottom shelf of the cabinet 12. As well known, continuous printer paper 18 includes a series of sheets of paper 20 coupled to one another in a head-to-toe relationship to form a continuous web of print receivable media 18. The sheets 20 may be blank or may have forms pre-printed thereon. The sheets may also include two or more layers, such that one or more carbon copies are simultaneously created when printing on the top sheet. Drive strips 22 are located along the sides of the sheets 20. The drive strips 22 have evenly spaced perforations engageable by the pins of a single pair of paper drive tractors for moving the printer paper 18 through the printer, as described below with respect to FIGS. 2 and 3.

FIGS. 2–7 are side elevation views of the printer mechanism 24 in various configurations. The printer mechanism 24 includes a paper drive assembly 26, a print head 28, a platen 30, and a paper iron assembly 32. Generally described, the printer mechanism 24 is configured to permit the printer 10 to print on printer paper fed/loaded from either side of the print head 28. The printer paper 18 can be printed in a continuous manner or in a single sheet manner, without the use of sacrificial sheets, i.e., without wastage.

The paper drive assembly 26 includes a pair of well known drive tractors 34 (one shown). The drive tractors 34 include a series of drive pins disposed on a flexible belt 36. The drive pins are spaced and sized to engage the perforations in the drive strips 22 (FIG. 1) of the printer paper 18. In a conventional manner, the flexible belts 36 are driven by a drive mechanism (not shown) in either direction. As the belts are moved, the drive pins either pull or push the printer paper 18 past the print head 28 and the platen 30, all in a conventional manner. The illustrated paper drive assembly 26 includes drive tractors 34 disposed on only one side of the print head 28.

Although the drive tractors of the paper drive assembly 26 are described as including flexible belts 36 for engaging perforations in a pair of drive strips 22 (FIG. 1), it will be apparent to those skilled in the art and others that other drive assemblies are suitable for use in other embodiments of the present invention. For example, a paper drive assembly including rollers with pins or rollers whose outer surfaces frictionally engage the printer paper can be employed in other embodiments of the invention.

The print head 28 is an impact print head, preferably a dot matrix line printer print head. As well known to those skilled in the art, dot matrix line printer print heads include a bank of hammers that are shuttled back and forth over a small number of character positions during printing. That is, rather than shuttling a small print head back and forth over the entire width of the printer paper 18 and printing characters in a serial manner, a dot matrix line printer print head 28 is wide and shuttled only over a few character positions. For example, the print head 28 may include 66 dot printing elements, each shuttled over two character positions, thereby covering 132 character positions. One line of dots is printed during each half of the shuttle motion cycle.

The bank of hammers includes a plurality of hammer springs (not shown) mounted along the length of the print head 28 in a conventional manner. See, for example, U.S. Pat. Nos. 4,833,980 and 4,793,252, the disclosures of which are hereby expressly incorporated by reference. During printing, the hammer springs are selectively released or fired such that dot printing elements impact the printer paper 18 through a length of ink ribbon (not shown) thereby printing images on the printer paper 18.

The platen 30 is a movable anvil aligned with the bank of print hammers and receives the impact force created by the print hammers. The platen 30 is an elongate member, generally cylindrical in shape. While the platen 30 is generally uniform in size and shape along the length of the platen 30, the shape of the platen 30 varies around the circumference of the platen 30, i.e., the radius of the platen changes around the circumference. The variation in radial distance allows the rotation of the platen 30 to selectively adjust the size of a print gap or platen gap 38, i.e., the space or gap between the print head 28 and the opposing outer surface of the platen 30. The platen gap 38 is adjusted to: (1) accommodate varying thicknesses of printer paper 18; (2) manipulate the friction between the print head 28 and the platen 30; and/or (3) to assist the loading of printer paper 18. While the platen 30 may be manually rotated, preferably the platen is power rotated by a suitable motor or other well known platen rotation mechanism.

The platen 30 includes at one or both ends a paper iron disengagement arm 40. The arm 40 is positioned to selectively engage a paper iron 42 that forms part of the paper iron assembly 32. The engagement moves the paper iron 42 between a paper load position and a paper tension position, as will be described in more detail below.

The paper iron assembly 32 also includes a leaf spring 44. The paper iron 42 is affixed along one edge of the leaf spring 44. The other edge of the leaf spring 44 is affixed to a base 46 positioned such that the paper iron 42 is cantilevered from the base 46. The leaf spring 44 biases the paper iron 42 toward the platen 30.

Figure 2:
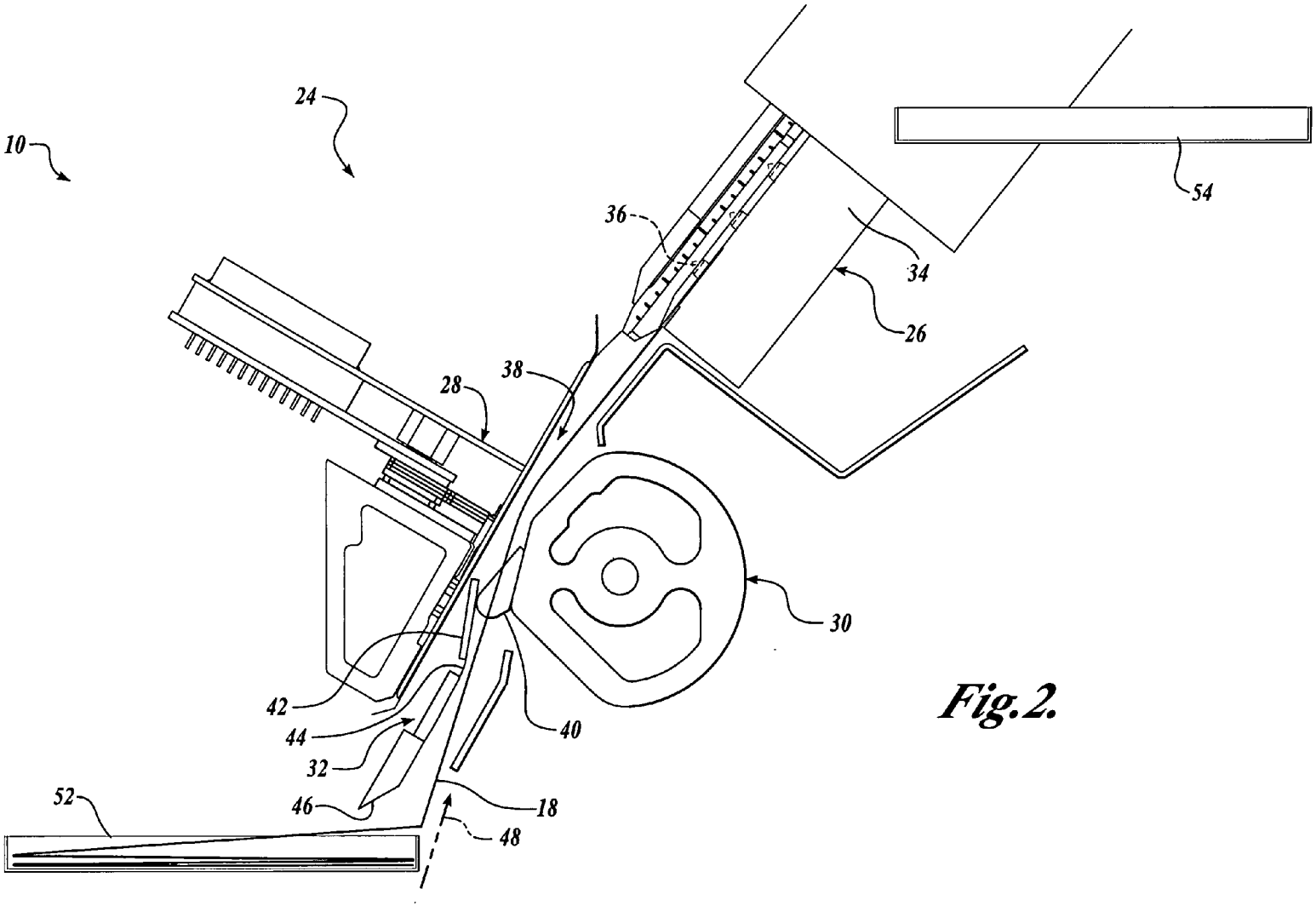
FIG. 2 is a side view of a printer mechanism suitable for embodying the invention that includes a single pair of drive tractors and a print head, the printer mechanism shown in a paper loading configuration and with continuous form paper being loaded from the side of the print head opposite the single pair of drive tractors from a lower paper bin.
Figure 3:
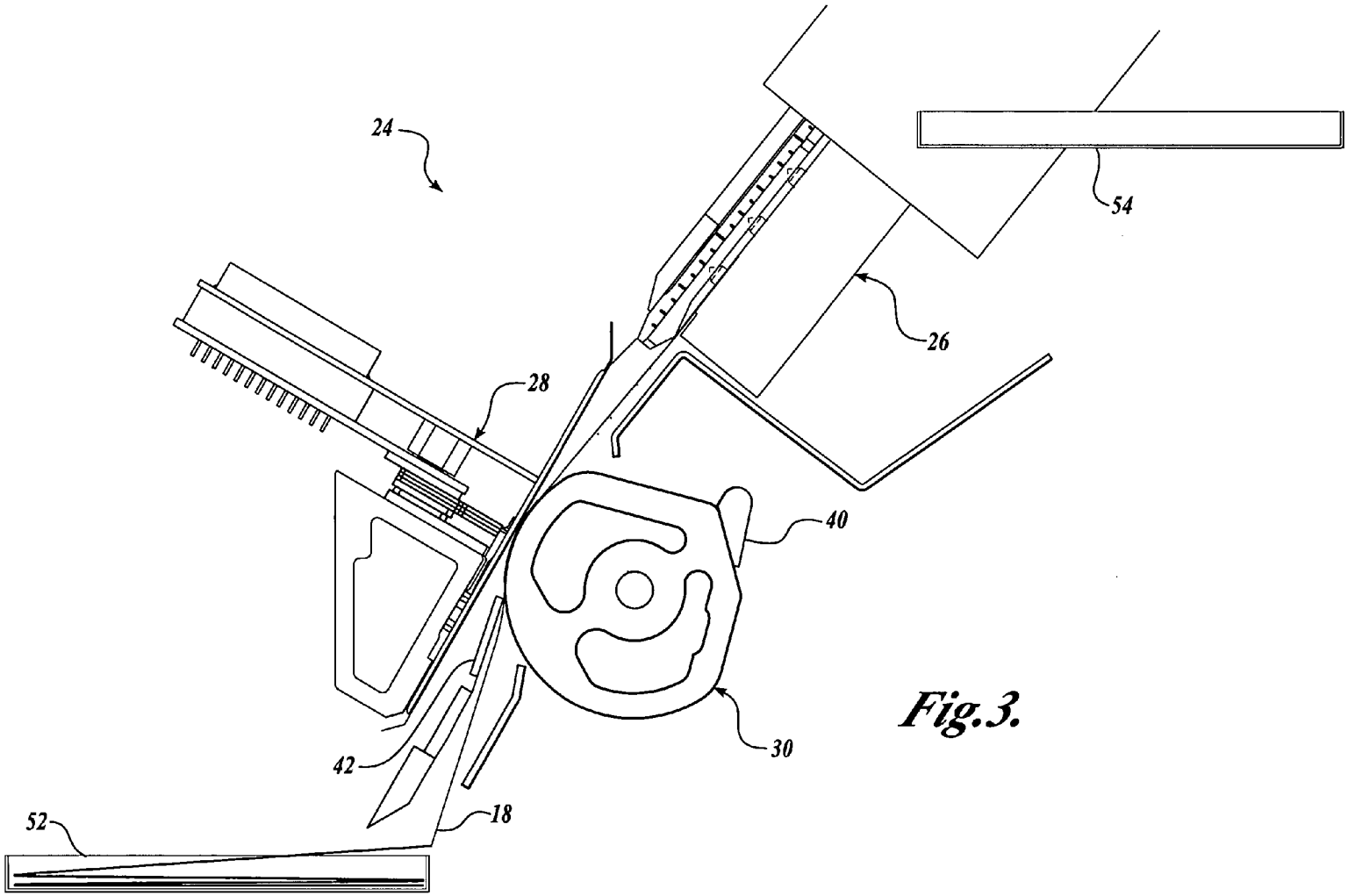
FIG. 3 is a side view of the printer mechanism depicted in FIG. 2, the printer mechanism shown in a printing configuration as the continuous paper is alternatingly pulled past the print head by the single pair of drive tractors and paused while printed upon.
Figure 6:
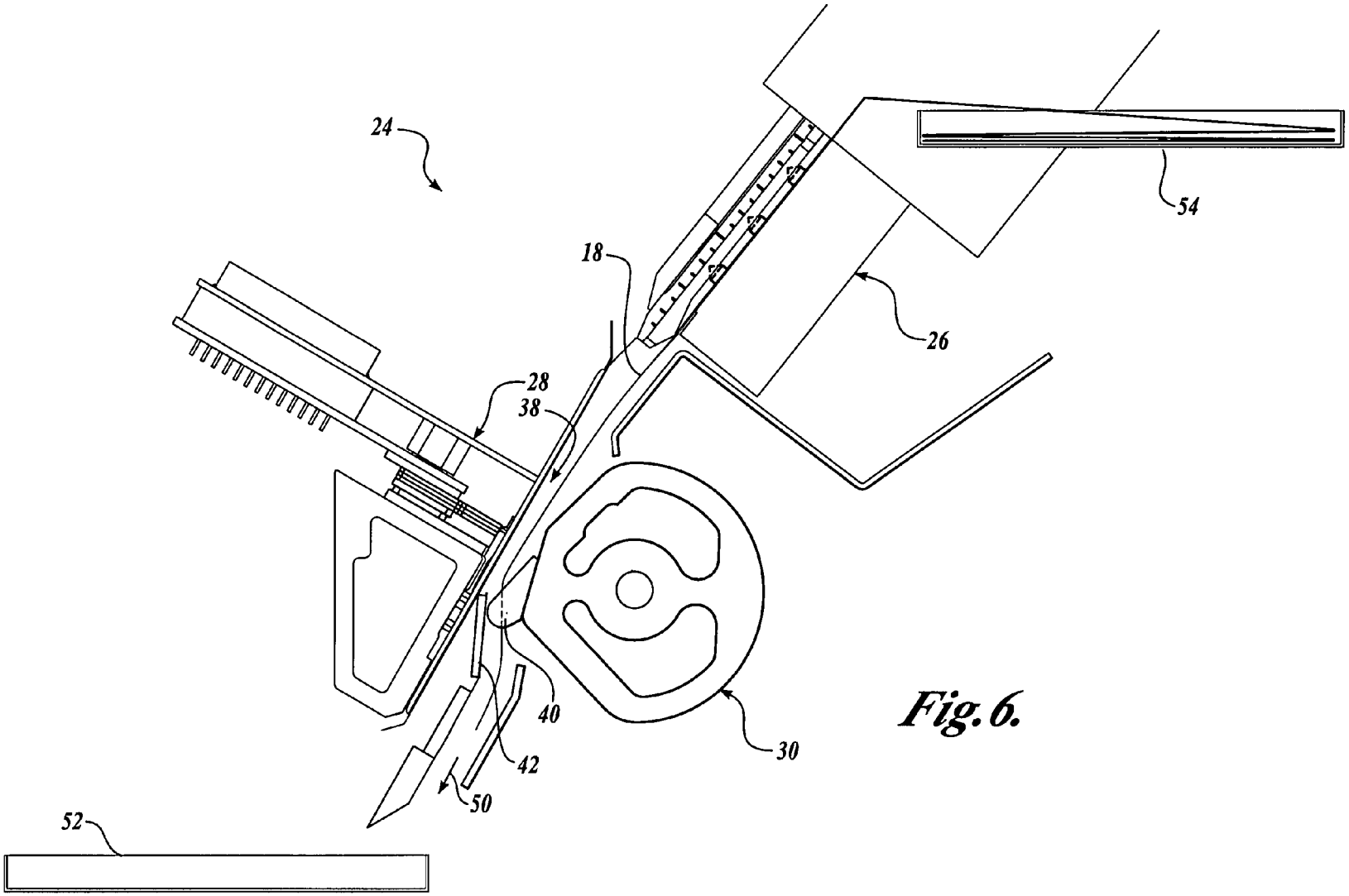
FIG. 6 is a side view of the printer mechanism depicted in FIGS. 2 and 3, the printer mechanism shown in a paper load configuration with continuous form paper being loaded from the single pair of drive tractors side of the print head to prepare the printer for single sheet pull printing.
Figure 7:
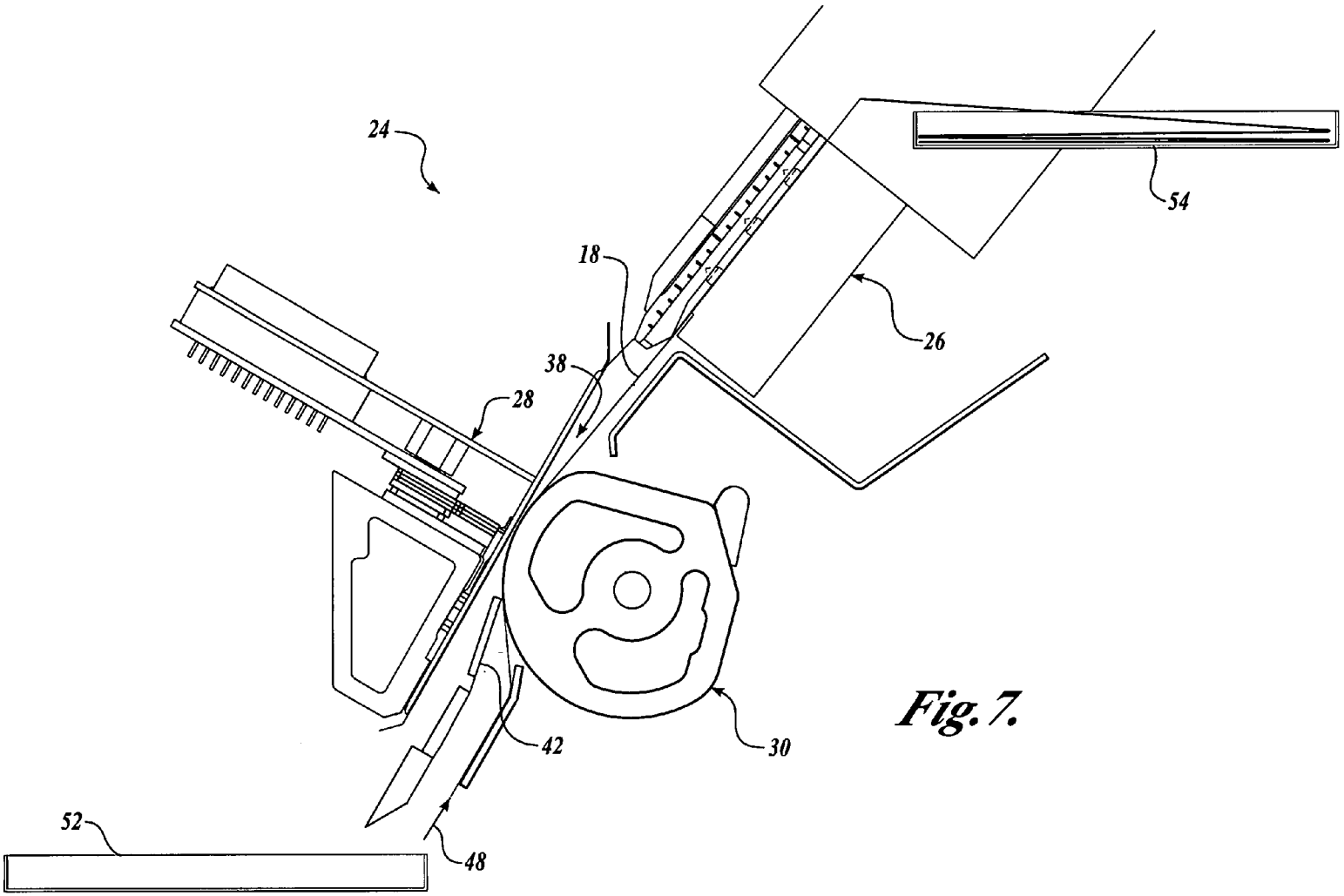
FIG. 7 is a side view of the printer mechanism depicted in FIG. 6, wherein the printer mechanism is shown in a single sheet pull printing configuration as the continuous paper is printed upon as the paper is initially moved past the print head and then alternatingly pulled past the print head and printed upon as paper movement is paused.

The paper iron 42 is positionable between a paper load position (shown in FIGS. 2, 4, and 6) and a paper tension position (shown in FIGS. 3 and 7). In the paper load position, the paper iron 42 is engaged by the paper iron disengagement arm(s) 40 of the platen 30. When engaged, the paper iron 42 is spaced from the outer surface of the platen 30, permitting printer paper 18 to pass relatively unimpeded between the paper iron 42 and the platen 30. In the paper tension position, the paper iron 42 is not engaged by the paper iron disengagement arm 40. As a result, the paper iron is biased by the leaf spring 44 toward the platen 30, thereby pressing the printer paper 18 against the outer surface of the platen 30. Thus, in the paper tension position, the paper iron 42 "pinches" the printer paper 18 against the platen 30 with a predetermined force. The friction caused by the predetermined force results in a consistent and controlled tension being applied to the printer paper 18 to thereby facilitate printing.

The printer 10 further includes two paper bins; a lower paper bin 52 and an upper paper bin 54. The paper bins 52 and 54 are sized and configured to hold the printer paper 18 in position for immediate use. Typically, the top edge of the paper will be loaded first since this is how the paper comes out of the box. Generally stated, when the printer paper 18 is loaded in the front of the printer in the lower paper bin 52, the print job is printed first line first, last line last and the print appears upright when viewed by a person standing in front of the printer. When the printer paper 18 is loaded in the back of the printer in the upper paper bin 54, the print job is printed last line first and first line last when pull printing. When push printing, the print job is printed first line first and last line last. The print will appear upside down when viewed by a person standing in front of the printer.

As will be understood from the following description of FIGS. 8–11, the printer mechanism 24 is controlled so as to print while printer paper 18 is fed in a forward or a backward direction. In the forward or downstream direction, indicated by arrow 48 in FIG. 2, the printer paper 18 is pulled by the paper drive assembly 26 past the print head 28. In the backward or upstream direction, indicated by the arrow 50 in FIG. 4, the printer paper 18 is pushed by the paper drive assembly 26 past the print head 28. The printer mechanism 24 is controllable to accept printer paper 18 loaded from either side of the print head 12. Typically, the printer paper 18 is loaded from the lower paper bin 52 when continuous printing is desired and from the upper paper bin 54 when single sheet printing is desired.

Referring to FIG. 2, the procedure for loading paper for feeding in the forward direction will now be described. First, the platen 30 is rotated in a clockwise direction to increase the platen gap 38 so that the printer paper 18 can pass relatively unimpeded between the print head 28 and the platen 30. Further, the platen 30 is selectively rotated such that the paper iron disengagement arm(s) 40 engages the paper iron 42, moving the paper iron 42 into a paper load position, thereby permitting the printer paper 18 to pass between the print head 28 and the platen 30 relatively unimpeded. The printer paper 18 is manually fed from the lower paper bin 52 in the direction of arrow 48 a distance sufficient for the perforations in the drive strips 22 to be engaged by the drive pins 36 of the paper drive assembly 26.

Referring to FIG. 3, after the printer paper 18 is loaded, the platen 30 is rotated in a counterclockwise direction. Rotating the platen 30 in the counterclockwise direction disengages the paper iron disengagement arm 40 from the paper iron 42, permitting the paper iron 42 to move into the paper tension position. Thereafter, the paper iron 42 maintains a selected tension on the printer paper 18. In a conventional manner, after the paper is suitably positioned, a line of dots are printed by the print head 28. Then the paper is pulled past the print head 28 by the paper drive assembly 26 the height of one line of dots, which aligns the print head 28 to print upon the next line of dots. A series of lines of dots creates a row of characters, or some other image.

As will be readily appreciated by those skilled in the art and others, the first sheet of the printer paper 18, or at least the portion of the printer paper 18 located beyond the print head 28, cannot be printed on. However, subsequent sheets can be fully printed, from top to bottom. Because loss of the first sheet does not significantly reduce printing efficiency during continuous printing, this loss is not a significant issue. If one thousand sheets are printed after the first sheet, the ratio of wasted sheets to useable sheets is 1/1000. However, if single sheets are printed using this approach, i.e., wherein one sheet is printed on and then torn off before the next sheet is printed, the ratio of wasted sheets would be 1/1, since each printed sheet would require a sacrificial sheet. As shown in FIGS. 4–7 and described next, the printer mechanism 24 is operated in a different manner when single sheets are to be printed that avoids this high wastage.

When single sheets are to be printed, the printer mechanism 24 is operated in the reverse (backward) direction. The printer paper 18 is loaded from the upper (downstream) paper bin 54 located at the back of the printer and pushed past the print head 28 in a backward direction, as indicated by the arrow 50 in FIG. 5. Feeding the printer paper 18 in the backward direction allows the top of the first sheet, i.e., the portion of the printer paper 18 located between the print head 28 and the paper drive assembly 26, to be printed on. This can be accomplished in either of two ways. If the printer paper is sufficiently stiff, it can be printed on while the paper is pushed backwards by the paper drive assembly 26. Alternatively, if the printer paper is weak, i.e., not stiff, the paper can be moved backward, entirely past the print head, before printing occurs. Then, the printer paper can be pulled past the print head as printing occurs.

Figure 4:
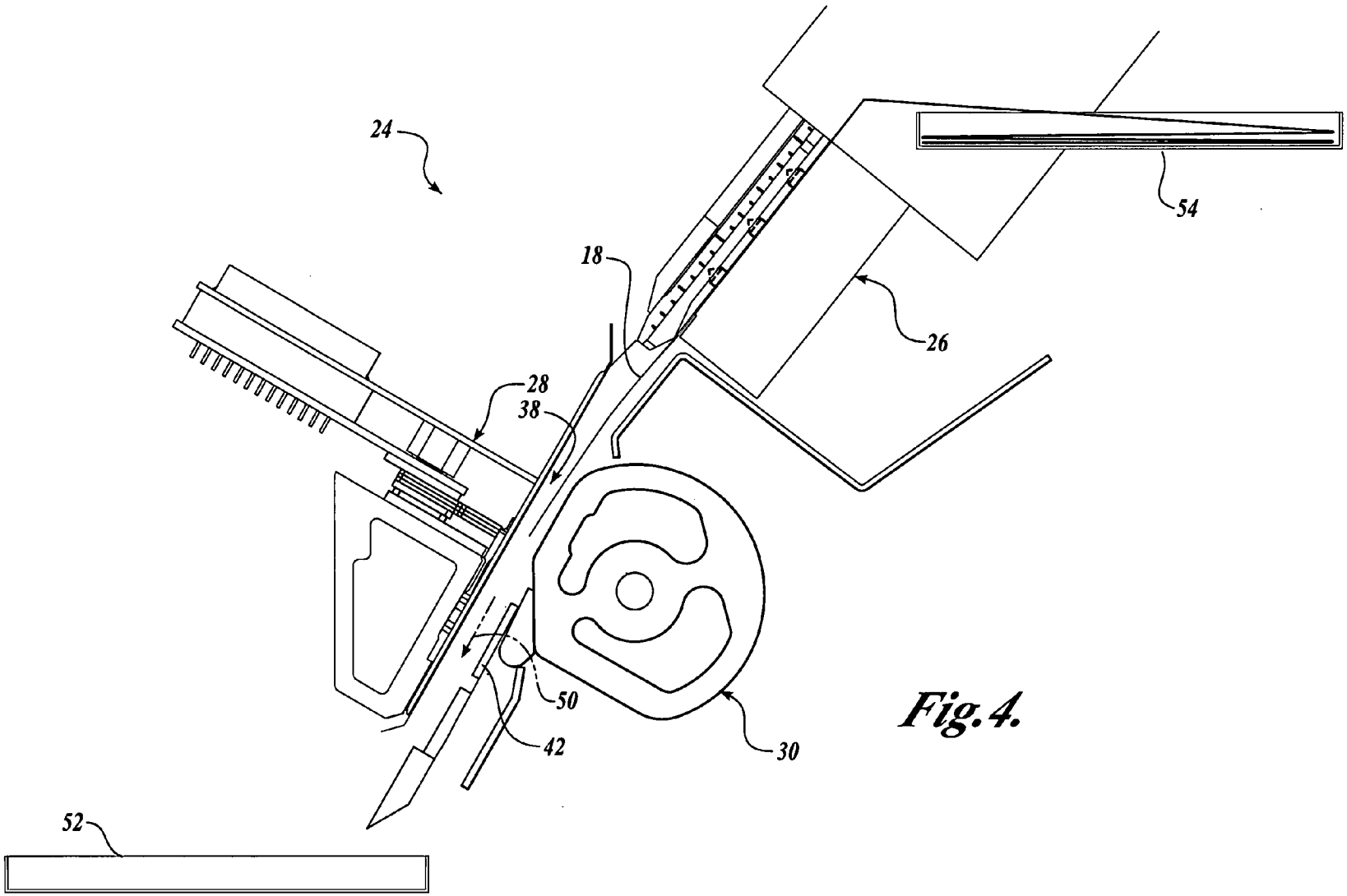
FIG. 4 is a side view of the printer mechanism depicted in FIGS. 2 and 3, the printer mechanism shown in a paper load configuration with continuous form paper being loaded from the single pair of drive tractors side of the print head to prepare the printer for single sheet push printing.

Referring to FIG. 4, the procedure for loading printer paper 18 from the upper paper bin 54 in the backward direction for single sheet push printing is described next. First, the platen 30 is rotated to open the platen gap 38 so that printer paper 18 can pass relatively unimpeded between the print head 28 and the platen 30. The printer paper 18 is manually fed in the direction of arrow 50 at least the distance between the print head 28 and the paper drive assembly 26 so that at least the lower edge of the printer paper 18 lies between the print head 28 and the platen 30.

Figure 5:
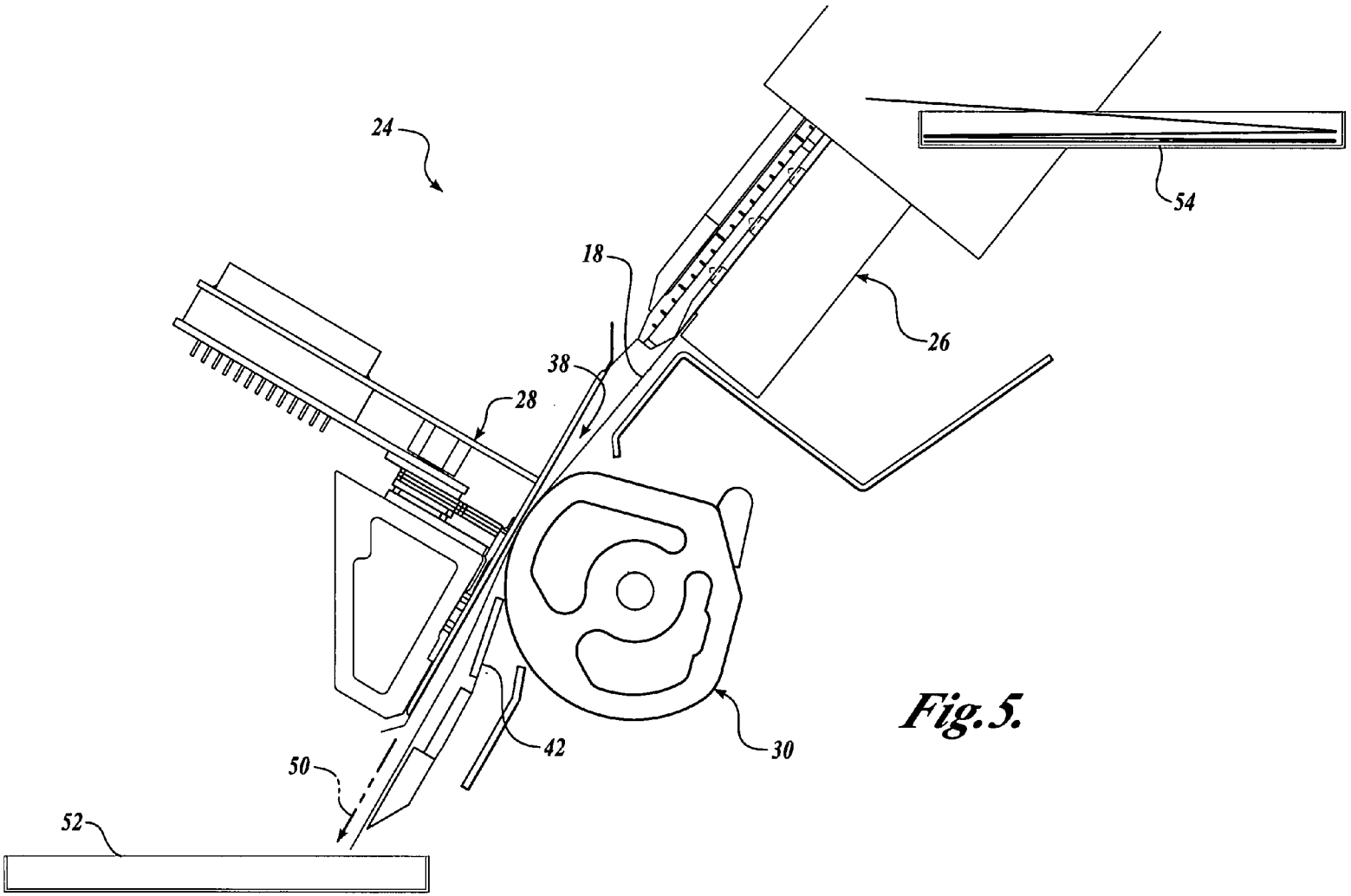
FIG. 5 is a side view of the printer mechanism depicted in FIG. 4, wherein the printer mechanism is shown in a single sheet push printing configuration as the continuous paper is printed upon as the paper is alternatingly pushed across the print head and printed upon as paper movement is paused.

Referring now to FIG. 5, after the paper is fed, the platen 30 is rotated in a counterclockwise direction to decrease the platen gap 38. Then, the printer paper 18 is printed on as the paper is pushed past the print head 28 in the direction of arrow 50. Preferably, in this mode of operation, the printer paper 18 passes above (preferably without touching) the paper iron 42. As a result, the paper iron 42 does not exert appreciable drag upon the printer paper 18. Preferably, the paper iron 42 does not even touch the printer paper 18. Thus, the paper iron 42 exerts no friction on the printer paper 18 thereby preventing the paper iron from buckling the printer paper 18 as the printer paper is pushed past the print head 28 by the paper drive assembly 26.

Referring to FIG. 6, the procedure for loading print paper 18 from the upper paper bin 54 in the backward direction for single sheet pull printing is described next. First the platen 30 is rotated to open the platen gap 38 so that the printer paper 18 can pass relatively unimpeded between the print head 28 and the platen 30. The platen 30 is rotated by an amount sufficient for the paper iron disengagement arm(s) 40 to engage the paper iron 42 and lift the paper iron 42 into the load paper position. With the paper iron 42 raised above the platen 30 in the load paper position, the printer paper 18 passes relatively unimpeded between the paper iron 42 and the platen 30. Preferably, enough printer paper 18 to complete the printing job is pushed, either manually or by the paper drive assembly 26, past the print head. Typically, a single sheet is pushed past the print head 28.

Referring now to FIG. 7, and as described more fully below, after the print paper 18 is fed, the platen 30 is rotated in a counterclockwise direction to decrease the platen gap 38 and move the paper iron into its paper drag position. The printer paper 18 is then printed on as the printer paper 18 is pulled past the print head 28 in the direction of arrow 48. Because, in this mode of operation, the printer paper 18 passes between the paper iron 42 and the platen 30, the paper iron 42 exerts a selected amount of drag upon the printer paper 18 to maintain the printer paper taut and improve print quality.

Regardless of which single sheet printing mode of operation occurs—push printing or pull printing—the sheets are printed in a single sheet, zero wastage manner, i.e., a manner that allows a single sheet to be printed and torn off without the wastage of a first sacrificial sheet. In the single sheet push printing mode of operation, the sheet of the printer paper 18 to be printed on is loaded such that the top edge of the first sheet is under the print head 28. The first sheet of the printer paper 18 is then alternatingly pushed past the print head 28 and paused while printed on by the print head 28. This process continues as the sheet is printed, line by line, in a top to bottom manner. The full length of the sheet is available for printing. The printed sheet may then be pushed a sufficient distance past the print head 28 to permit a user to tear off the sheet for immediate use. The printer paper may then be pulled back toward the paper drive assembly 26 to align the top edge of the next sheet with the print head 28. The next sheet may then be printed on as the sheet is pushed past the print head 28. No sacrificial sheets are wasted.

The images (e.g., characters) printed on the sheets of the printer paper 18, when the paper is loaded from the upper bin 54 and fed in the backward direction, are preferably printed upside down relative to the orientation of the images printed when the printer paper is loaded from the lower bin 52 and fed in the forward direction. This is done so that the images are correctly oriented relative to any forms preprinted on the sheets of printer paper 18. More specifically, when continuous printer paper 18 is loaded from the lower bin side of the print head 28 and fed beginning to end in the forward direction, a preprinted form on the first sheet is oriented in a first direction. However, if the same continuous printer paper 18 is loaded from the upper bin side of the print head 28 and fed beginning to end in the backward direction, the printer paper 18 is now oriented upside down relative to the preprinted form. Any images printed on the printer paper 18 oriented and fed in this way need to be printed upside down relative to the orientation of the images when printed in the forward direction. Alternatively, continuous printer paper loaded from the upper bin side of the print head can be fed end to beginning in the backward direction. In this case, the form and printed images are oriented correctly, except that printing is from end to beginning in the push mode of operation. However, operation in this manner typically would require an operator to remove the continuous paper from its box to obtain access to the last sheet of the stack.

Figure 8:
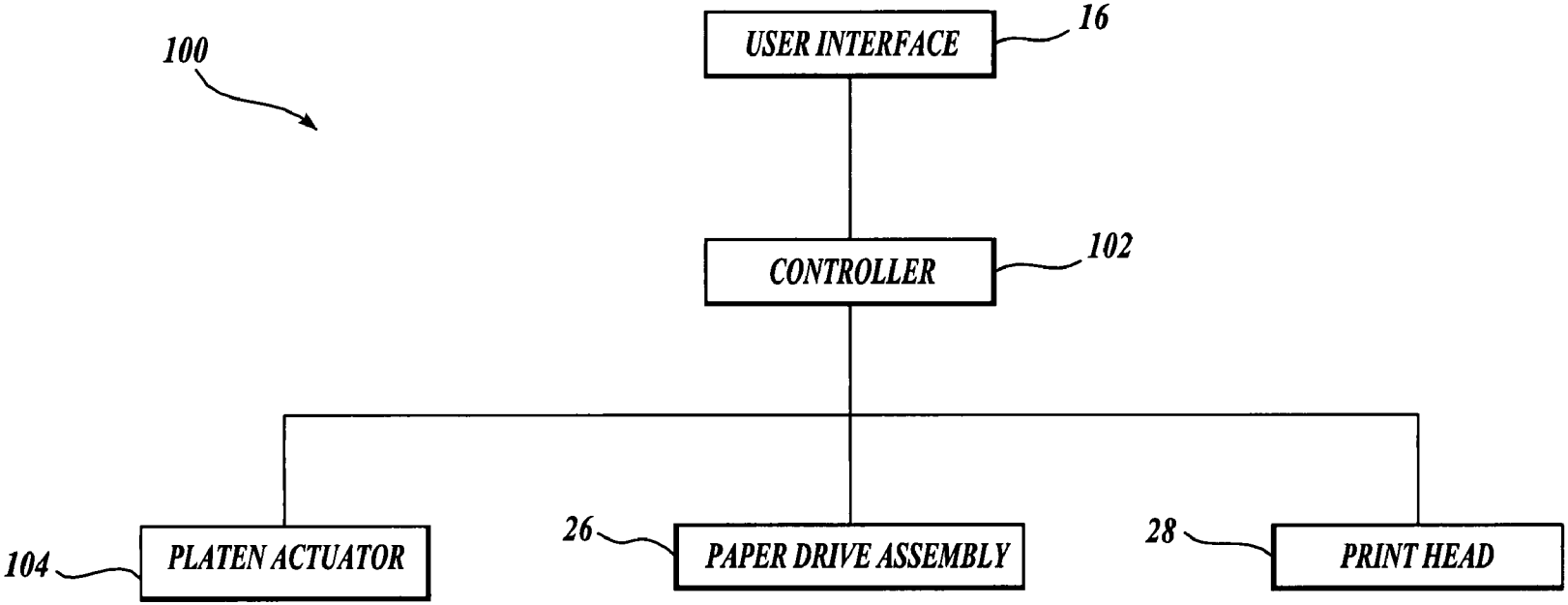
FIG. 8 is a block diagram of one embodiment of the present invention.
Figure 9:
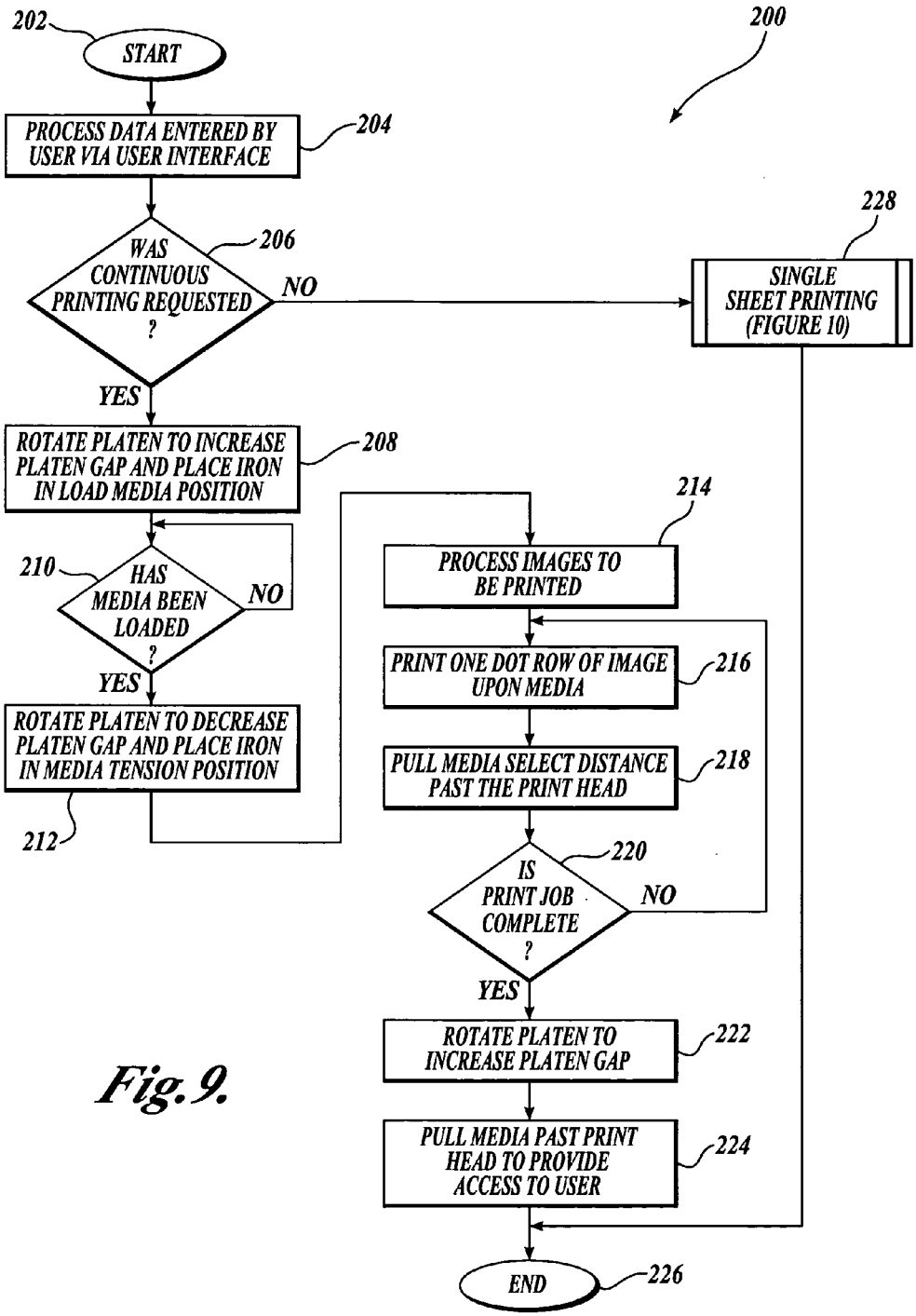
FIG. 9 is an exemplary functional flow diagram illustrating the operation of the embodiment of the invention depicted in FIG. 8.
Figure 10:
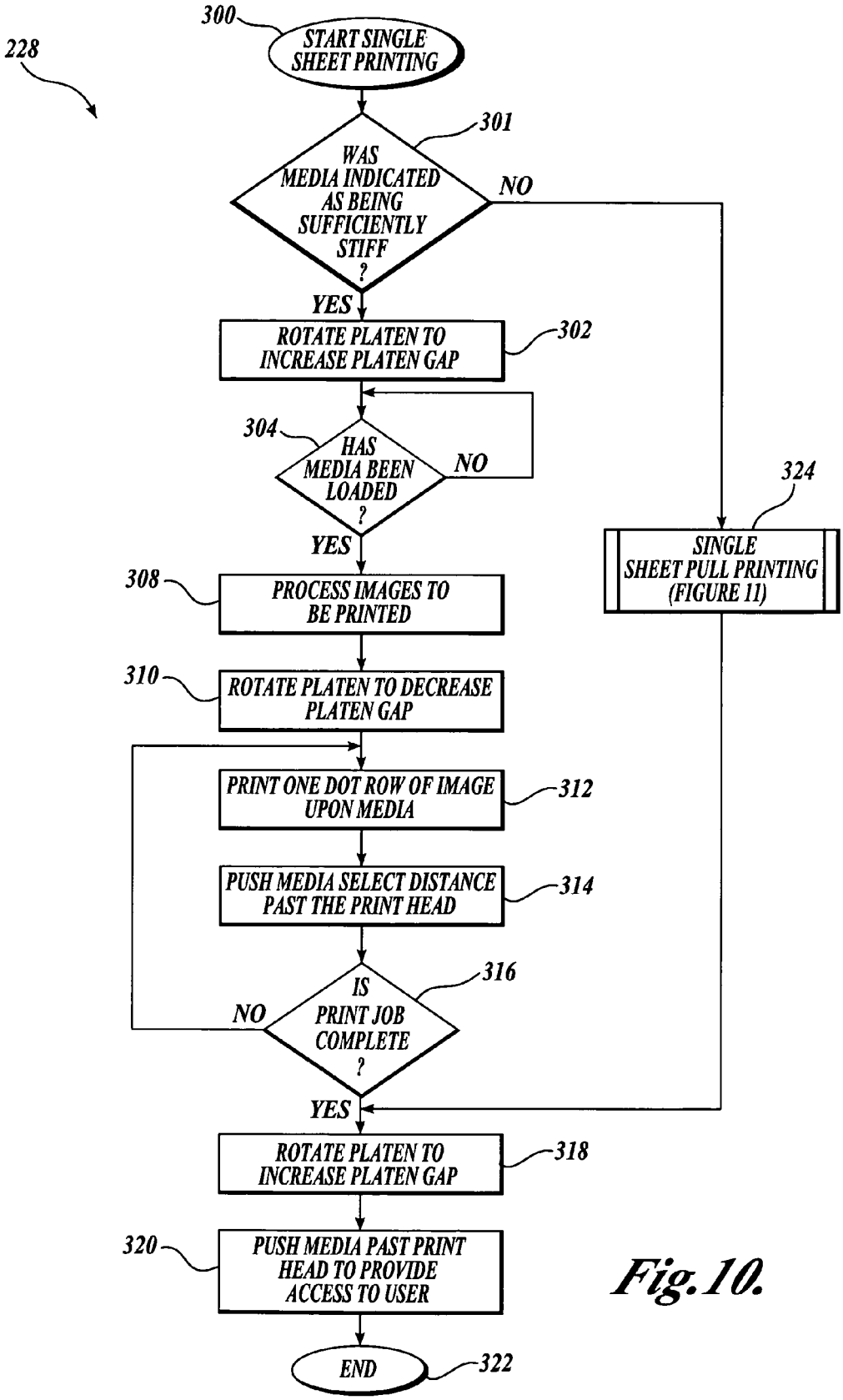
FIG. 10 is an exemplary functional flow diagram of a single sheet push printing subroutine suitable for use in FIG. 9.
Figure 11:
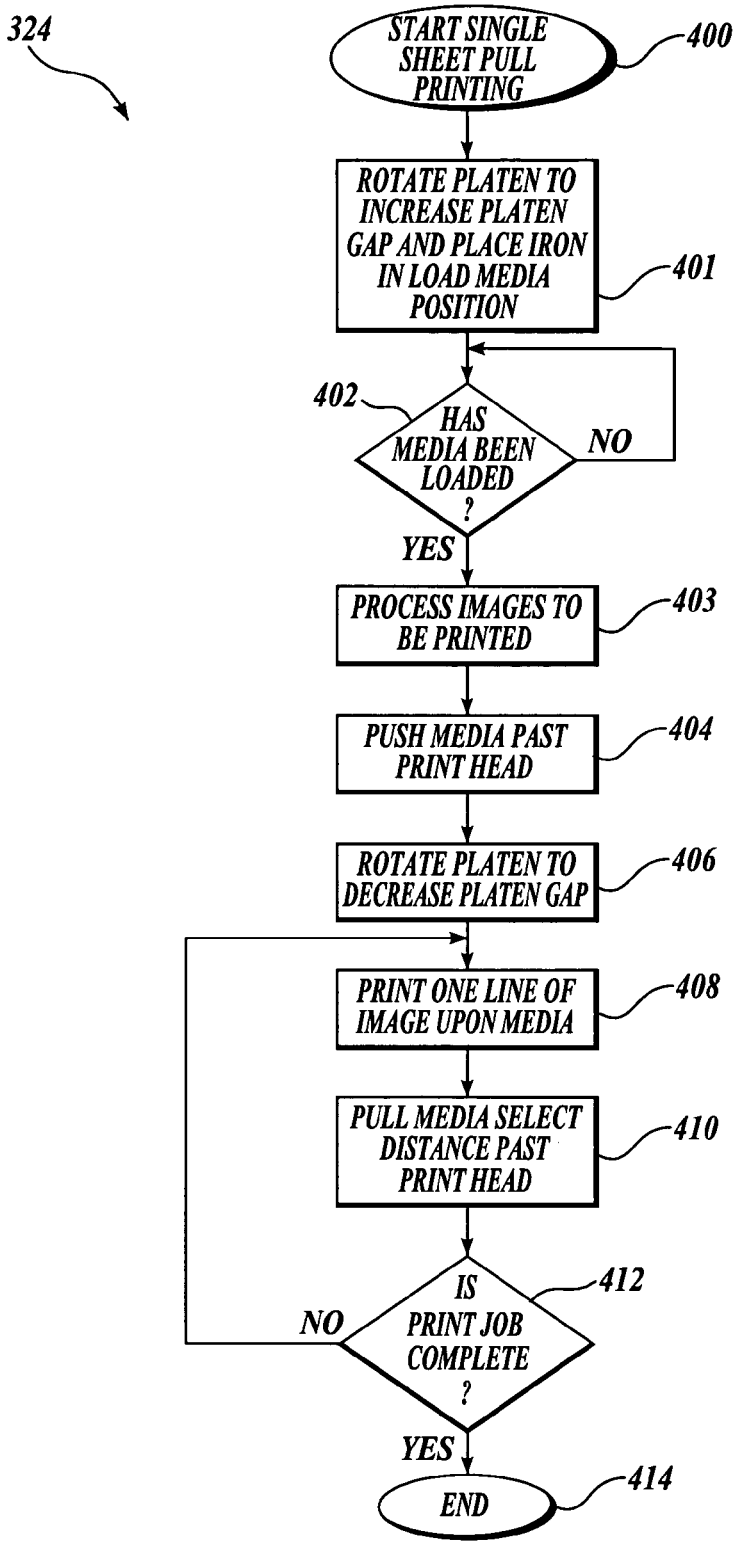
FIG. 11 is an exemplary functional flow diagram of a single sheet pull printing subroutine suitable for use in FIG. 10.

FIG. 8 is a block diagram of a printer 100 formed in accordance with the present invention. In addition to the major elements of the printer mechanism shown in FIGS. 2–7, the printer 100 includes a controller 102. The controller 102 receives user instructions or commands from a suitable source, such as the user interface 16 and, in accordance therewith, communicates with and/or controls a platen actuator 104, the paper drive assembly 26, and the print head 28, including the print hammers and shuttle mechanism associated with the print head 28. More specifically, the controller 102 receives user instructions from the user interface 16 and sends display information to the user interface. User instructions include: whether continuous printing or single sheet printing is desired; if single sheet printing is desired, whether push or pull printing is to occur; if continuous printing is to occur, the number of copies, etc. The controller 102, based upon the user's instructions, controls the platen actuator 104, the paper drive assembly 26, and the print head 28 in the manner described above. The actions of the controller 102 are governed by control logic, an example of which is shown in FIGS. 9–11 and described next. Since controllers and control logic are well known, no specific hardware for performing the described functions is described herein for the sake of brevity.

FIG. 9 is a functional flow diagram showing the program or routine that controls the operation of the printer described herein. The routine 200 shown in FIG. 9 begins at block 202 and proceeds to block 204, where printing instructions entered by the user via the user interface are processed. The routine then proceeds to a decision block 206, where a test is made to determine if continuous printing was requested. If continuous printing was requested, the routine proceeds to block 208. At block 208, the platen is rotated to increase the platen gap to facilitate the passage of the printer paper between the platen and the print head during loading. Further, as shown in FIG. 2, the platen is rotated far enough that the paper iron disengagement arm engages the paper iron and moves the paper iron into the paper load position. This movement facilitates the passage of printer paper between the paper iron and the platen. The paper is then manually loaded from the lower paper bin, i.e., from the side of the print head opposite the paper drive assembly.

The routine then proceeds to decision block 210, where a test is made to determine if the printer paper has been loaded. As will be readily apparent to those skilled in the art and others, the determination of whether the printer paper has been loaded may be accomplished in any number of suitable ways, such as automatically by the use of any one of a number of well known sensors or in response to user input received from the user interface, for example. Decision block 210 remains in an endless loop until it is determined that the printer paper has been loaded. The routine then proceeds to block 212. At block 212, the platen is rotated to decrease the platen gap and to place the paper iron in the paper tension position. Thus, the printer is prepared to begin printing.

The routine then proceeds to block 214 where the images to be printed are processed for printing. Because continuous printing was requested (block 206), printing occurs in a rightside up manner. The routine then proceeds to block 216 where the first line of images is printed on the printer paper. As well known to those skilled in the art of line printers, if the images are a line of characters, this is accomplished by printing a "line" of dots indexing the printer paper, printing another line of dots, etc., until the first line of character images is printed. Other well known techniques are used to create pictures or other images. The routine then proceeds to block 218 where the printer paper is pulled a selected distance past the print head, the selected distance being to the next row of dots to be printed. The routine then proceeds to decision block 220, where a test is made to determine if the print job is complete. If the print job is not complete, blocks 216 and 218 are repeated until the print job is complete. After the print job is complete, the routine proceeds from decision block 220 to block 222. At block 222, the platen is rotated to increase the platen gap. After the platen gap is increased, the routine proceeds to block 224 where the printer paper is pulled past the print head to a position where the user can access (either visually or physically) the now printed paper, to either visually assess the printed images and/or tear off a sheet of printer paper. The routine then proceeds to block 226, where the process ends, i.e., the controller is shut down or placed in hibernation until a new printing process is begun at start block 202.

Returning to decision block 206, if it is determined that continuous printing was not requested, the routine proceeds to a single sheet printing subroutine 228. An exemplary single sheet printing subroutine 228 is illustrated in FIG. 10 and described next.

At block 300 the single sheet printing subroutine begins. Processing promptly proceeds to block 301, wherein a test is made to determine if the printer paper was indicated (by the user) as sufficiently stiff (i.e., having a stiffness equal to or greater than a selected stiffness). As noted above, if the printer paper is of a sufficient stiffness, the printer paper can be pushed past the print head during printing without the printer paper buckling to a degree where print quality is significantly affected. If the paper is not stiff enough to be pushed past the print head during printing without significantly affecting print quality, the routine proceeds to a single sheet pull printing subroutine 324 illustrated in FIG. 11 and described below.

If it is determined at decision block 301 that the paper is sufficiently stiff, the subroutine 228 proceeds to block 302 where the platen is rotated to increase the platen gap to facilitate the loading of printer paper. The printer paper is loaded from the upper paper bin 54, i.e., the leading end of the printer paper is brought into engagement with the pins 36 of the paper drive assembly 26. While this could be done automatically, in most printers embodying the invention, loading of paper will be done manually. The subroutine 228 then proceeds to decision block 304, where a test is made to determine if the printer paper has been loaded. The determination of whether the printer paper has been loaded may be accomplished through the use of any number of well known means, as discussed above with respect to block 210 (FIG. 9). Decision block 304 remains in an endless loop until is determined that the printer paper has been loaded, at which time the subroutine proceeds to decision block 308.

At decision block 308, the images to be printed on the printer paper are processed for printing. The single sheet printing subroutine 228 then proceeds to block 310 where the platen is rotated to decrease the platen gap to facilitate printing by the print head. The gap size is chosen to minimize friction on the printer paper as the paper is pushed past the print head. The subroutine 228 then proceeds to block 312 where, as described above (block 216, FIG. 9), one line of the image is printed on the printer paper. The subroutine then proceeds to block 314 where the printer paper is pushed a selected distance past the print head. As discussed above with respect to block 216, the selected distance is determined by the nature of the images and the nature of the printer paper.

The routine then proceeds to decision block 316, where a test is made to determine if the print job is complete. If the print job is not complete, blocks 312 and 314 are repeated until the print job is complete. After the print job is complete, the subroutine 228 proceeds to block 318. At block 318, the platen is rotated to increase the platen gap. After the platen gap is increased, the routine proceeds to block 320 where the printer paper is pushed past the print head to a position where the user can access (either visually or physically) the now printed paper, to either visually assess the printed images and/or tear off a sheet of printed paper. The routine then proceeds to block 322, where the subroutine ends. Processing then returns to block 226 of FIG. 9, where processing ends.

Returning to FIG. 10, if the paper is not sufficiently stiff, as noted above, the single sheet printing subroutine 228 executes the single sheet pull printing subroutine 324, an example of which is shown in FIG. 11 and described next. The single sheet pull printing subroutine 324 begins at block 400 and then proceeds to block 401. At block 401, the platen is rotated to increase the platen gap to facilitate the passage of the printer paper between the platen and the print head during loading. Further, the platen is rotated far enough that the paper iron disengagement arm engages the paper iron and moves the paper iron into the paper load position. This movement facilitates the passage of printer paper between the paper iron and the platen. The paper is then manually loaded from the upper paper bin, i.e., from the paper drive assembly side of the print head.

The subroutine 324 then proceeds to decision block 402, where a test is made to determine if the printer paper has been loaded. The determination of whether the printer paper has been loaded may be accomplished through the use of any number of well known means, as discussed above with respect to block 210 (FIG. 9). Decision block 402 remains in an endless loop until it is determined that the printer paper has been loaded, at which time the subroutine proceeds to block 403.

At block 403, the images to be printed are processed for printing. During single sheet pull printing, images are printed in an upside down orientation.

The single sheet pull printing subroutine then proceeds to block 404, where the printer paper is pushed past the print head. Preferably, the printer paper is pushed past the print head to the point where one full sheet of the printer paper lies beyond the print head. The subroutine 324 then proceeds to block 406 where the platen is rotated to decrease the platen gap. The single sheet pull printing subroutine then proceeds to block 408 where the print head prints one image line of print, similar to the line of print printed in blocks 216 (FIG. 9) and 312 (FIG. 10). The subroutine 324 then proceeds to block 410 where the media is pulled a selected distance past the print head, the selected distance being determined in the manner described above with respect to block 218 (FIG. 9). The single sheet pull printing subroutine then proceeds to decision block 412, where a test is made to determine if the print job is complete. If the print job is not complete, blocks 408 and 410 are repeated until the print job is complete. After the print job is complete, processing proceeds to block 414 where the single sheet pull printing subroutine 324 ends. At block 414, the single sheet pull printing subroutine 324 returns to the single sheet printing subroutine 228 illustrated in FIG. 10 and described above.

While the presently preferred embodiment of the invention has been illustrated and described, it will be appreciated that various changes can be made therein without departing from the spirit and scope of the invention as defined by the appended claims.

The embodiments of the invention in which an exclusive property or privilege is claimed are defined as follows:

1. A printer for printing upon a continuous web of print receivable media, the printer comprising:

(a) a print head having a media drive assembly side;

(b) a media drive assembly for moving continuous web print receivable media past the print head, the media drive assembly being disposed on the media drive assembly side of the print head;

(c) a platen disposed adjacent the print head; and (d) a controller coupled to said print head, said media drive assembly, and said platen for controlling the modes of operation of said printer in accordance with user input, the modes of operation of said printer including a continuous print mode of operation and a single sheet mode of operation, wherein during said continuous print mode of operation, said print head, said media drive assembly, and said platen are controlled such that said media is moved by said media drive assembly past said print head in a downstream direction, wherein during said single sheet mode of operation, said print head, said media drive assembly, and said platen are controlled such that said media is moved by said media drive assembly past said print head in an upstream direction one sheet at a time, and wherein said single sheet mode of operation includes a single sheet push mode of operation and a single sheet pull mode of operation, wherein during said single sheet push mode of operation, said print head, said media drive assembly, and said platen are controlled such that said media is pushed past said print head in said upstream direction during printing, and wherein during said single sheet pull mode of operation, said print head, said media drive assembly, and said platen are controlled such that said media is first pushed past said print head in said upstream direction and, then, during printing, is pulled in said downstream direction.

2. The printer of claim 1, further including an iron located on an opposite side of said print head from said media drive assembly for pressing said media against said platen when said printer is in said continuous print mode of operation or said single sheet pull mode of operation.

3. The printer of claim 2, wherein a position of said iron with respect to said platen is controlled by said controller.

4. The printer of claim 3, wherein during said single sheet push mode of operation said controller positions said iron so that said media passes over said iron rather than being pressed by said iron against said platen.

5. The printer of claim 2, wherein the platen is rotatably mounted and includes an iron disengagement member, and wherein the controller selectively rotates the platen such that the iron disengagement member interacts with the iron to move the iron from a media tension position to a media load position.

6. The printer of claim 5, wherein the controller selectively rotates the platen to adjust the gap between the outer surface of the platen and the print head.

7. The printer of claim 1, wherein the controller causes the print head to print in a top to bottom direction when in the continuous print mode of operation and in the single sheet push mode of operation, and wherein the controller causes the print head to print in a bottom to top direction when in the single sheet pull mode of operation.

8. A printer for printing upon a continuous web of print receivable media, the printer comprising:

(a) a print head having a media drive assembly side;

(b) a media drive assembly having at least one driver for moving the media across the print head, the driver disposed only on the media drive assembly side of the print head;

(c) a platen disposed adjacent to the print head; and (d) a controller coupled to the print head, media drive assembly, and platen to control the printer to print upon the media in a continuous pull printing manner, wherein the controller controls the media drive assembly to alternatingly advance the media by pulling the media past the print head and pause media movement during printing by the print head upon the media, and in a single sheet pull printing manner, wherein the controller controls the media drive assembly to push a sheet of the media past the print head and then alternatingly advance the media by pulling the media back past the print head and pause media movement during printing by the print head.

9. The printer of claim 8, wherein the printer includes an iron and wherein during continuous pull printing and single sheet pull printing, the media passes between the iron and the platen.

10. A method of controlling a printer to perform continuous sheet printing and single sheet pull printing, the printer having a print head for printing upon a web of continuous print receivable media, a media drive assembly having at least one driver for moving the media, wherein the driver is located on only one side of the print head, the method comprising:

(a) determining if continuous sheet printing is desired, and if continuous sheet printing is desired, directing the media drive assembly to alternatingly:

(i) pause printing and advance the media by pulling the media across the print head; and (ii) pause media movement while printing; and (b) determining if single sheet pull printing is desired, and if single sheet pull printing is desired, directing the media drive assembly to push a first sheet of the media past the print head, and to alternatingly advance the media back past the print head by pulling the media and pause media movement while the print head prints upon the media.

11. The method of claim 10, wherein the printer also includes a platen disposed adjacent the print head and an iron disposed adjacent the platen, and wherein the media passes between the platen and the iron during continuous sheet printing.

12. The method of claim 10, wherein the printer also includes a platen disposed adjacent the print head and an iron disposed adjacent the platen, and wherein the media passes between the platen and the iron during single sheet pull printing.

* * * * *